US010830485B2

(12) United States Patent
Prihoda et al.

(10) Patent No.: US 10,830,485 B2
(45) Date of Patent: Nov. 10, 2020

(54) AIR-CONDITIONING DIFFUSER FOR AIR DISTRIBUTION

(71) Applicant: PRIHODA s.r.o., Hlinsko (CZ)

(72) Inventors: Zdenek Prihoda, Hlinsko (CZ); Michal Bures, Hlinsko (CZ)

(73) Assignee: PRIHODA s.r.o., Hlinsko (CZ)

( * ) Notice: Subject to any disclaimer, the term of this patent is extended or adjusted under 35 U.S.C. 154(b) by 396 days.

(21) Appl. No.: 15/302,204

(22) PCT Filed: Apr. 7, 2015

(86) PCT No.: PCT/CZ2015/000031
§ 371 (c)(1),
(2) Date: Oct. 6, 2016

(87) PCT Pub. No.: WO2015/154729
PCT Pub. Date: Oct. 15, 2015

(65) Prior Publication Data

US 2017/0030608 A1 Feb. 2, 2017

(30) Foreign Application Priority Data

Apr. 7, 2014 (CZ) ..... 2014-29425
Mar. 9, 2015 (CZ) ..... 2015-30827

(51) Int. Cl.
*F24F 13/02* (2006.01)
*F24F 13/068* (2006.01)
(Continued)

(52) U.S. Cl.
CPC ..... *F24F 13/0218* (2013.01); *F24F 13/062* (2013.01); *F24F 13/068* (2013.01);
(Continued)

(58) Field of Classification Search
CPC .. F16L 11/00; F16L 41/18; F16L 41/00; F24F 13/02; B32B 3/10
(Continued)

(56) References Cited

U.S. PATENT DOCUMENTS 2,075,258 A * 3/1937 Anderson ..... B01F 3/02 454/261
2,863,606 A * 12/1958 Tatsch ..... F16L 41/18 237/69
(Continued)

FOREIGN PATENT DOCUMENTS

EP 2357294 A2 8/2011
EP 2573479 A2 3/2013
(Continued)

OTHER PUBLICATIONS

International Searching Authority, International Search Report and Written Opinion issued in International Application No. PCT/CZ2015/000031, dated Jul. 7, 2015, 9 pages.

*Primary Examiner* — Edelmira Bosques
*Assistant Examiner* — Frances F. Hamilton
(74) *Attorney, Agent, or Firm* — Wood Herron & Evans LLP

(57) ABSTRACT

Air-conditioning diffuser for distributing air, comprising a chamber (10) provided with an inlet orifice (30) for feeding air and with an outlet wall (20) made of a woven or non-woven fabric or foil, the outlet wall (20) comprising at least one array of through-holes (22) for distributing air into the surrounding environment. The air-conditioning diffuser further comprises a plurality of air deflecting pockets (23) for redirecting the air flowing through the through-holes (22) out of the air-conditioning diffuser, each air deflecting pocket (23) being attached to the outlet wall (20) on the outer side of the same, overlapping at least one through-hole
(Continued)

(22) spaced apart from the through-hole and being open towards the space adjoining the outlet wall (20).

11 Claims, 6 Drawing Sheets

(51) Int. Cl.
*F24F 13/062* (2006.01)
*F24F 13/06* (2006.01)

(52) U.S. Cl.
CPC ... *F24F 2013/0608* (2013.01); *F24F 2221/14* (2013.01); *F24F 2221/17* (2013.01)

(58) Field of Classification Search
USPC ..... 138/118; 237/69; 454/71, 74, 76, 296, 454/903, 136
See application file for complete search history.

(56) References Cited

U.S. PATENT DOCUMENTS 3,733,996 A * 5/1973 Naccarato ..... B60H 1/267 454/128
3,792,595 A * 2/1974 Willis ..... B60P 3/20 62/414
4,050,365 A * 9/1977 Freeman, Jr. ..... B60H 1/00014 454/108
4,343,506 A * 8/1982 Saltzman ..... B62D 35/001 105/1.2
4,354,648 A * 10/1982 Schenk ..... B64C 3/58 244/130
5,058,837 A * 10/1991 Wheeler ..... B64C 23/06 244/198
5,598,990 A * 2/1997 Farokhi ..... B64C 23/06 244/198
5,655,963 A * 8/1997 Paschke ..... F24F 13/068 454/297
5,807,171 A * 9/1998 Felsen ..... F24F 13/06 454/296
5,833,389 A * 11/1998 Sirovich ..... B64C 21/10 405/52
6,142,417 A * 11/2000 Figge, Sr. ..... B64D 33/02 137/15.1
6,508,076 B1 * 1/2003 Gast ..... B65D 88/745 62/408
6,582,011 B2 * 6/2003 Palazzolo ..... B60H 1/0055 296/208
7,517,279 B2 * 4/2009 Kober ..... B60H 1/34 454/152
7,556,223 B2 * 7/2009 Acheson ..... B64C 1/1453 244/129.1
7,625,275 B1 * 12/2009 Hoke ..... B60H 1/28 454/147
7,690,598 B1 * 4/2010 Plattner ..... B64D 13/02 244/129.1
8,439,628 B2 * 5/2013 Maldonado ..... F01D 5/186 415/115
8,544,533 B2 * 10/2013 Lee ..... B60H 1/00064 165/202
8,808,075 B2 * 8/2014 Gebke ..... B32B 3/10 138/118
8,936,660 B2 * 1/2015 Cruz Aguado ..... F24F 7/00 454/196
9,464,532 B2 * 10/2016 Sutton ..... F01D 7/00
9,636,967 B2 * 5/2017 Clark ..... B60H 1/00014
10,246,134 B1 * 4/2019 Radyk ..... B62D 25/18
10,434,841 B2 * 10/2019 Ertel ..... F25D 17/06
2002/0056985 A1 * 5/2002 Szakurski ..... B62D 25/16 280/848
2003/0190886 A1 * 10/2003 Hirasawa ..... H01L 21/67173 454/187
2004/0229559 A1 11/2004 Gebke et al.
2006/0252365 A1 * 11/2006 Gebke ..... F24F 13/0209 454/306
2008/0203218 A1 * 8/2008 Anderson ..... B64D 13/00 244/58
2009/0318072 A1 * 12/2009 Perera ..... F16L 55/027 454/194
2010/0291852 A1 * 11/2010 Steinert ..... B64D 13/02 454/71
2010/0327117 A1 * 12/2010 Gemma ..... F41H 11/02 244/136
2011/0009045 A1 * 1/2011 Beckley ..... B60H 1/00564 454/162
2011/0269390 A1 * 11/2011 Pinkalla ..... F16L 11/02 454/284
2011/0287708 A1 * 11/2011 Timko ..... A47B 31/02 454/338
2012/0006442 A1 * 1/2012 Gebke ..... B32B 5/02 138/118
2012/0064818 A1 * 3/2012 Kurelowech ..... F24F 12/006 454/251
2013/0118493 A1 * 5/2013 Umlauft ..... A62B 7/00 128/204.18
2014/0169825 A1 * 6/2014 Momomura ..... G03G 15/0291 399/92
2014/0295747 A1 * 10/2014 Schmid ..... B64D 13/00 454/76
2015/0072609 A1 * 3/2015 Bromley ..... A61G 13/108 454/187
2015/0099447 A1 * 4/2015 Oh ..... G06F 1/20 454/184
2015/0110518 A1 * 4/2015 Nagamori ..... G03G 21/206 399/92
2016/0193484 A1 * 7/2016 Riedel ..... A62B 7/14 128/202.13
2016/0377313 A1 * 12/2016 Leiterman ..... F24F 13/0236 454/296
2018/0021469 A1 * 1/2018 Kim ..... F24F 13/222 454/233

FOREIGN PATENT DOCUMENTS

EP 2578957 A1 4/2013
WO 2006102996 A1 10/2006

* cited by examiner

AIR-CONDITIONING DIFFUSER FOR AIR DISTRIBUTION

FIELD OF THE INVENTION

The present invention relates to an air-conditioning element for air distribution comprising a chamber provided with an inlet for feeding air and with an outlet wall made of a woven or non-woven fabric or foil, the outlet wall comprising at least one array of through-holes for distributing air into the surrounding environment.

BACKGROUND OF THE INVENTION

The known flat air-conditioning diffusers, which constitute the prior art concerned and serve for distributing air, are typically made of woven or non-woven fabrics or foils and consist of a framework structure covered with a textile stuffing material (ceiling or wall based diffusers). The outlet wall of a diffuser may be perforated or provided with through-holes, the air distribution taking place through such perforation or holes. Distributing air in a proper manner is one of the most important functions of an air conditioning distribution system.

While straight ducting elements are typically required to enable that the air exits them in a direction, which is perpendicular to the walls of such elements, the use of ceiling or wall based diffusers makes it desirable that the exiting air streams flow in diverse directions.

One of the drawbacks, which mainly relate to the known framework structures comprising textile diffusers, consists in that an undesirable draught can develop in the case that the distributed air is flowing in a single direction from such a diffusor.

In ceiling and wall based diffusers, the outlet orifices formed by perforated or micro-perforated sections are mostly insufficient with regard to the distributed air volume.

The objective of the present invention is to develop an air-conditioning ducting element in the form of a ceiling or wall based diffuser for distributing air or an air-conditioning duct for transporting and distributing air, which diffuser or duct has to be simple with regard to design and manufacturing, and enable to direct the outlet air flow in a manner that will cause the distributed air to enter a room in a desired direction without causing a draught. At the same time, all the advantages of a textile or foil distribution system must be maintained, particularly its lightweight structure and the possibility to machine-wash the same.

SUMMARY OF THE INVENTION

The above specified objective is achieved with an air-conditioning element for distributing air, comprising a chamber provided with an inlet orifice for feeding air and with an outlet wall made of a woven or non-woven fabric or foil, the outlet wall comprising at least one array of through-holes for distributing air into the surrounding environment. According to the invention it further comprises a plurality of air deflecting pockets for redirecting the air flowing through the through-holes out of the air-conditioning diffuser, each air deflecting pocket being attached to the outlet wall on the outer side of the same, overlapping at least one through-hole spaced apart from the through-hole and being open towards the space adjoining the outlet wall.

The air deflecting pocket is attached to the outlet wall advantageously by means of a pair of its lateral edges, which mutually form an acute angle, and/or the air deflecting pocket defines a cavity which widens towards outlet orifice of the air deflecting pocket, wherein preferably the air deflecting pocket assumes a shape corresponding to a part of the shell of a truncated cone.

Preferably, the air-conditioning element further comprises an array of auxiliary holes formed in the outlet wall, wherein it is advantageous, when at least some of the auxiliary holes have an area ranging between 0.1 to 1 $mm^2$, particularly between 0.1 and 0.3 $mm^2$ and when at least some of the through-holes have an area which is larger than that of the auxiliary holes.

Advantageously, the air-conditioning element is constituted by a ceiling or wall based diffuser, the array of auxiliary holes is arranged in a circular and the through-holes with the corresponding air deflecting pockets are adapted for directing the air flow in a direction tangential with respect to at least one circle that is concentric with the circular plane containing the auxiliary holes.

The air deflecting pocket may open towards the space adjoining at least some of the auxiliary holes belonging to said array of auxiliary holes in order to direct the air stream flowing via the through-hole into the air stream flowing out of at least some of the auxiliary holes.

The air-conditioning element is constituted by an air-conditioning duct comprising an inlet orifice for feeding air, an outlet orifice for leading port of the air away and an outlet wall for distributing the air into surrounding environment.

BRIEF DESCRIPTION OF THE DRAWINGS

For more detail, the present invention will be further described with reference to the accompanying drawings showing exemplifying embodiments, wherein.

DESCRIPTION OF THE EXEMPLARY EMBODIMENTS

Figure 4:
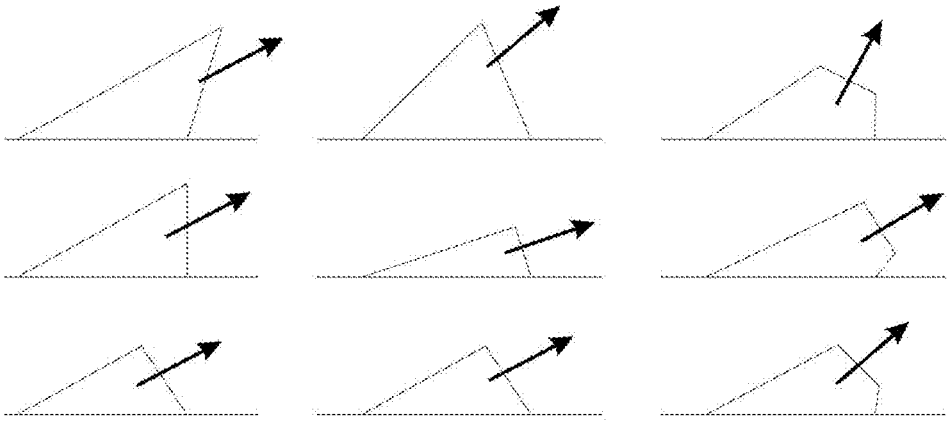
Figure 5:
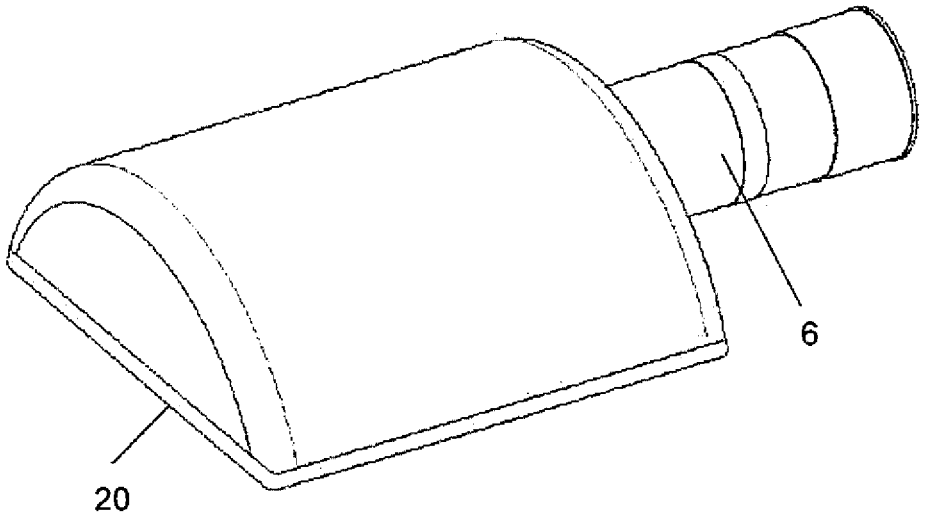
FIG. 5 shows a diffuser according to the present invention in a perspective top side view, the diffuser having a downward facing outlet wall.
Figure 6:
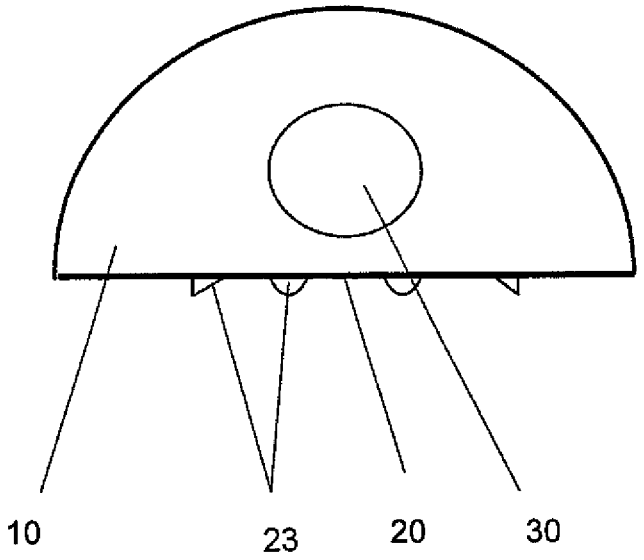
FIG. 6 shows the diffuser of FIG. 5 in a sectional view.

The first exemplary embodiment of the present invention relates to an air-conditioning duct. As illustrated in FIGS. 1A to 1D, the outlet wall 20 of the air-conditioning duct described herein comprises an array of through-holes 22 for distributing air into the environment surrounding the duct, on the one hand, and an array of auxiliary holes 21, which are arranged upstream the array of through-holes 22 with respect to the direction of the air flow, on the other hand. An air deflector, such as an air deflecting pocket 23, is assigned to each through-hole 22, said pocket being attached to the outer surface of the corresponding wall of the air-conditioning duct. When viewed in a projection which is perpendicular to the outlet wall 20 of the air-conditioning duct, the air deflecting pocket 23 entirely covers the corresponding through-hole 22 from the outside. The through-hole 22 leads into a hollow space that is formed between the corresponding air deflecting pocket 23 and the outlet wall 20 of the air-conditioning duct. The air deflecting pocket 23 widens towards the array of auxiliary holes 21 and it is also open towards the array of auxiliary holes 21. Preferably, the air deflecting pocket 23 may assume a shape that is shown in FIGS. 2A and 2B, namely a shape corresponding to a partial lateral area of a cone or truncated cone. Nevertheless, other shapes are also feasible, such as those corresponding to a partial lateral area of a pyramid, truncated pyramid, of a sphere or the like. Possible shapes of the air deflecting pocket 23, including the indication of the direction of the air flow, which has exited the corresponding through-hole 22 and has been deflected by such pocket 23, are illustrated in FIG. 4. In order to ensure a consistent shape and a proper function of the air deflecting pocket 23, the lateral sides of the same are attached to the wall of the air-conditioning duct. The lateral sides of the air deflecting pockets 23 shown in the right-hand column in FIG. 4 surround the entire circumference of the corresponding through-hole 22, thus substantially forming a shape of an oblique truncated cone. The shapes of the air deflecting pockets 23, which are shown in the left-hand and middle columns in FIG. 4 or, as the case may be in other figures, are more preferable from the structural point of view, wherein the air deflecting pocket 23 only surrounds a portion of the circumference of the corresponding through-hole 22 and does not extend into the area between the particular through-hole 22 and the respective auxiliary holes 21.

Preferably, the through-hole 22 is larger than the auxiliary hole 21, i.e. the cross-sectional area or the diameter of the through-hole 22 is larger than those of the auxiliary holes 21.

It may be also useful to make the cross-sectional area of the through-hole 22 smaller in comparison to the cross-sectional area of the perpendicular projection of the corresponding air deflecting pocket 23 on the plane of the outlet wall 20.

Figure 1A:
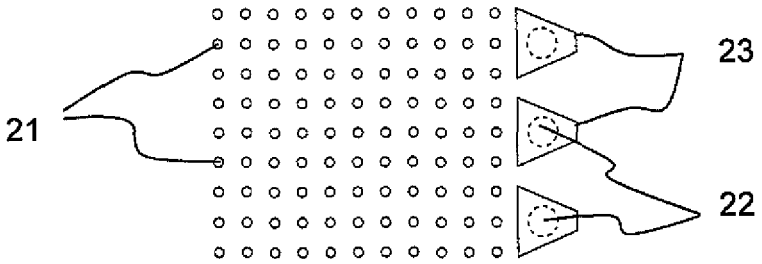
FIG. 1A shows an outlet wall of the air-conditioning element according to a first exemplary embodiment.
Figure 1B:
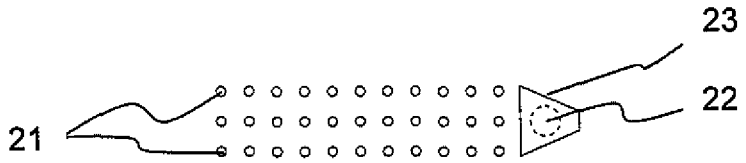
FIG. 1B shows an outlet wall of the air-conditioning element according to a second exemplary embodiment.
Figure 1C:
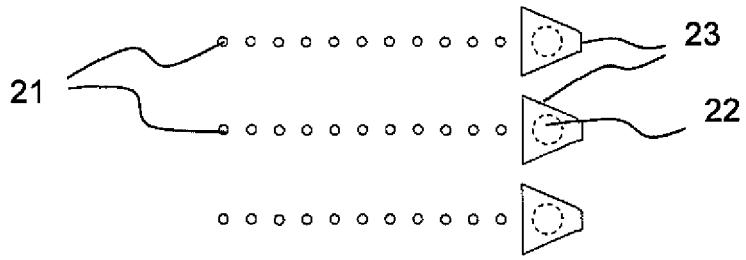
FIG. 1C shows an outlet wall of the air-conditioning element according to a third exemplary embodiment and FIG. 1D shows an outlet wall of the air-conditioning element according to a fourth exemplary embodiment.
Figure 1D:
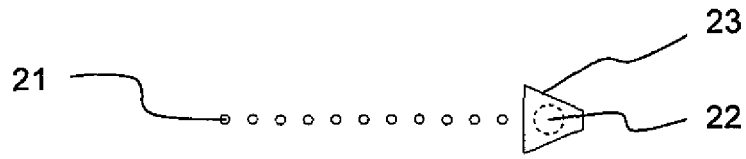
Figure 2A:
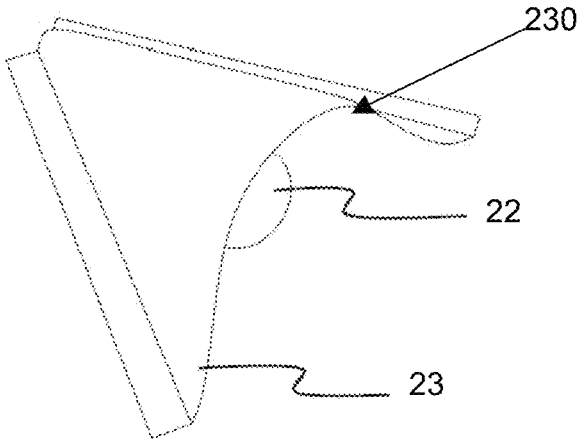
FIG. 2A shows a first exemplary embodiment of an air deflecting pocket and FIG. 2B shows a second exemplary embodiment of an air deflecting pocket in a perspective view, FIG. 3 schematically indicates the direction of the air flow exiting the air-conditioning element according to the present invention, FIG. 4 schematically indicates possible shapes of the air deflecting pocket in a side view.
Figure 2B:
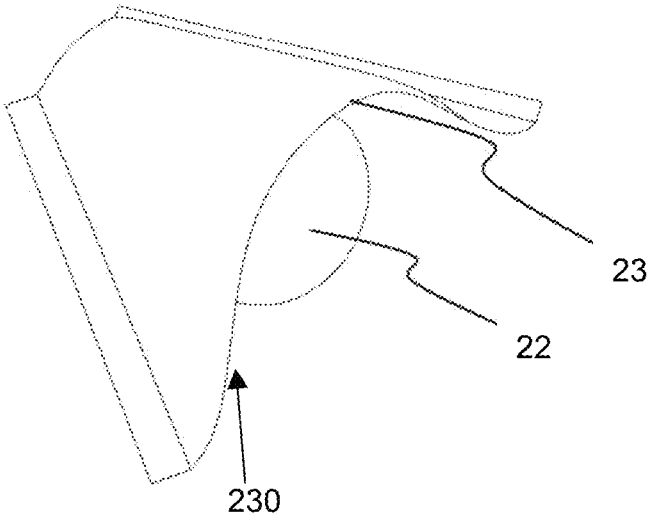

A single through-hole 22 with the corresponding air deflecting pocket 23 can be assigned to a single row of the related auxiliary holes 21 (as illustrated in FIGS. 1C and 1D) or to multiple rows of the related auxiliary holes 21 (as illustrated in FIGS. 1A and 1B). In either case, it is preferable to assign each through-hole 22 with the corresponding air deflecting pocket 23 to an array of the auxiliary holes 21.

Figure 3:
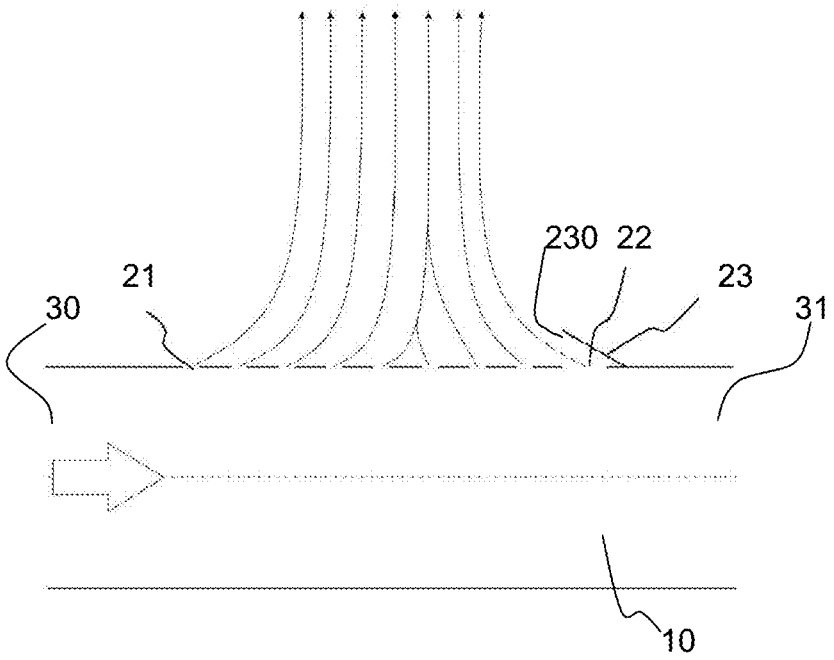

The air-conditioning duct according to the present technical solution works in the following way: The inlet 30 of the air-conditioning duct is supplied with air. The latter flows through the air-conditioning duct towards the outlet 31, the direction of such air flow being indicated by means of a wide arrow in FIG. 3. A certain portion of the airflow, however, is exiting the duct via the auxiliary holes 21. The direction of such partial air streams intersects that of the main air flow, which is being fed towards the auxiliary holes 21 inside the air-conditioning duct, at an obtuse angle. The air flow, which is exiting via a through-hole 22, is directed by the corresponding air deflecting pocket 23 into a space facing the auxiliary holes 21 on the outer side. The direction of the air flow exiting the air deflecting pocket 23 intersects that of the main air flow, which is being fed towards the corresponding auxiliary hole 21 inside the air-conditioning duct, at an acute angle. Consequently, the air flow, which is exiting via the through-hole 22, will strike the air, which is leaving the auxiliary holes 21, causing the same to swirl or rectifying the direction of the same towards radial (perpendicular) direction.

Another exemplary embodiment of the present invention is described with reference to FIGS. 5 to 8. As clearly seen in the relevant drawings, a ceiling or wall based air-conditioning diffuser is concerned herein. This diffuser comprises the chamber 10 provided with the inlet 30 for feeding air or for connecting an air supply pipework 6. Preferably, the chamber 10 is made of a woven or non-woven fabric or foil.

In accordance with the present technical solution, the chamber 10 further comprises the outlet wall 20, which is also made of a woven or non-woven fabric or foil, and an array of the through-holes 22 for distributing the air from the chamber 10 into the surrounding environment.

An air deflecting pocket 23 is assigned to each through-hole 22, said pocket being attached to the outer surface of the outlet wall 20 of the air-conditioning diffuser. Similarly to the above described first embodiment, the air deflecting pocket 23 entirely covers the corresponding through-hole 22 from the outside when viewed in a projection which is perpendicular to the outlet wall 20. The through-hole 22 leads into an open hollow space that is formed between the corresponding air deflecting pocket 23 and the outlet wall 20 of the air-conditioning diffuser. The air deflecting pocket 23 widens towards its outlet orifice 230. Again, the air deflecting pocket 23 may preferably assume a shape that is shown in FIG. 4 or in FIG. 8, namely a shape corresponding to a partial lateral area of a cone or to that of a truncated cone. Nevertheless, other shapes are also feasible, such as those corresponding to a partial lateral area of a pyramid, truncated pyramid, sphere or the like. In order to ensure a consistent shape and, thus, a proper function of the air deflecting pocket 23, the lateral sides of the same are attached to the wall of the air-conditioning duct.

Figure 7:
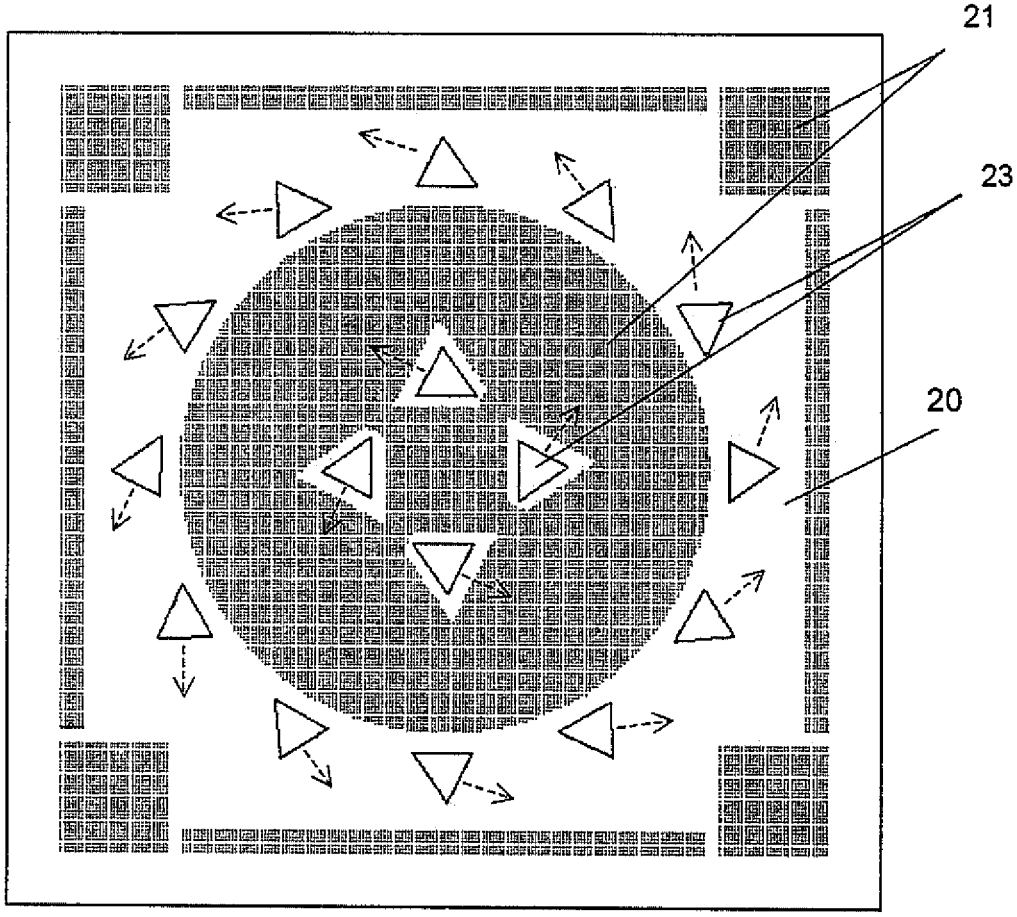
FIG. 7 shows a particularly preferred embodiment of the diffuser wall.
Figure 8:
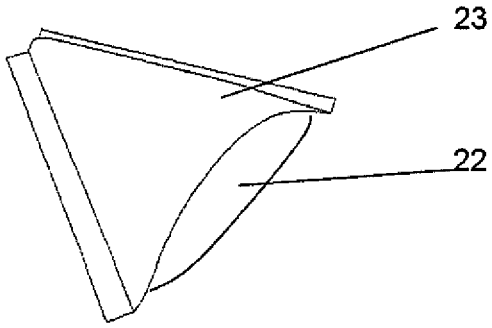
FIG. 8 shows another preferred embodiment of the air deflecting pocket and the through-hole.

The arrangement of the individual air deflecting pockets 23 enables the respective air streams to be deflected in different directions. Preferably, the air should flow out from the array of the air deflecting pockets 23 in different lateral directions, at least in the area adjoining the corresponding outlet wall 20. More preferably, the directions of the individual air streams should extend tangentially with respect to a common circle or to a pair or a plurality of concentric circles. In FIG. 7, the direction of the air flow exiting the air deflecting pockets 23 is indicated by means of dashed-line arrows. Alternatively, the arrangement of the air deflecting pockets 23 may be adapted to deflect the air streams exiting from the through-holes 22 perpendicularly to the edges of the corresponding outlet wall 20 and/or radially with respect to a circle having its centre in the central area of the outlet wall 20.

The air deflecting pockets 23 according to the present exemplary embodiment are generally adapted for diverting the air stream flowing out of the respective through-hole 22 away from the direction, which is perpendicular to the plane of the outlet wall 20, or for aligning such air stream with the plane of the outlet wall 20. Again, each individual air deflecting pocket 23 preferably directs the corresponding air stream in a different direction.

Preferably, the cross-sectional areas of the through-holes 22 are as large as possible. For example, the cross-sectional area of each through-hole may correspond to the area of the perpendicular projection of the hollow space inside the respective air deflecting pocket 23. In a further preferred embodiment, at least some of the through-holes 22 may have their cross-sectional areas smaller in comparison to the areas of the perpendicular projections of the respective assigned air deflecting pockets 23.

In order to increase the flow rate of the air passing through the outlet wall 20, the array of the through-holes 22 with the corresponding air deflecting pockets 23 may be supplemented with auxiliary holes 21, which are not provided with air deflecting pockets 23 assigned to them. Preferably, the auxiliary holes 21 are smaller than the through-holes 22. This means that the auxiliary holes 21 may be formed by providing the outlet wall 20 with a micro-perforated or perforated portion. Preferably, each auxiliary hole 21 has a cross-sectional area ranging between 0.1 and 1 $mm^2$, more preferably between 0.15 and 0.3 $mm^2$.

In the exemplary embodiment shown in FIG. 7, the auxiliary holes 21 are arranged so as to form two arrays, the one array being deployed in a circular plane and the other one being deployed along the circumference of the outlet wall 20. In the present exemplary embodiment, the through-holes 22 are also arranged in two arrays, the one array being deployed inside the circular plane containing the auxiliary holes 21 and the other one being deployed along the circumference of said circular plane.

The air deflecting pockets 23, which are arranged outside the circular plane containing the auxiliary holes 21, preferably divert the individual air streams in a substantially tangential direction with respect to a circle that is concentric with the circular plane containing the basic through-holes 22.

The air deflecting pockets 23, which are arranged inside said circular plane containing the auxiliary holes 21, preferably divert the individual air streams in mutually concurrent directions, such concurrent directions being mutually perpendicular ones in the present exemplary embodiment. Nevertheless, said air deflecting pockets may also be seen as diverting the air in directions extending tangentially with respect to a circle that is concentric with the circular plane containing the auxiliary holes 21.

The air-conditioning diffuser according to the present embodiment works in the following way: The inlet 30 of the chamber 10 is supplied with the air which subsequently reaches the air-conditioned room via the holes 21, 22. A certain amount of the air exits via the auxiliary holes 21, the direction of the corresponding air streams being perpendicular to the outlet wall 20. The air streams, which exit via the through-holes 22, are redirected by the respective air deflecting pockets 23 into a space adjoining the outlet wall 20, the directions of the individual air streams being different. Simultaneously, said air streams entrap at least a partial amount of the air flowing out of the auxiliary holes 21. Thereby, a predominantly swirling or centrifugal direction of the overall air stream flowing out of the air-conditioning diffuser is achieved.

Figure 9:
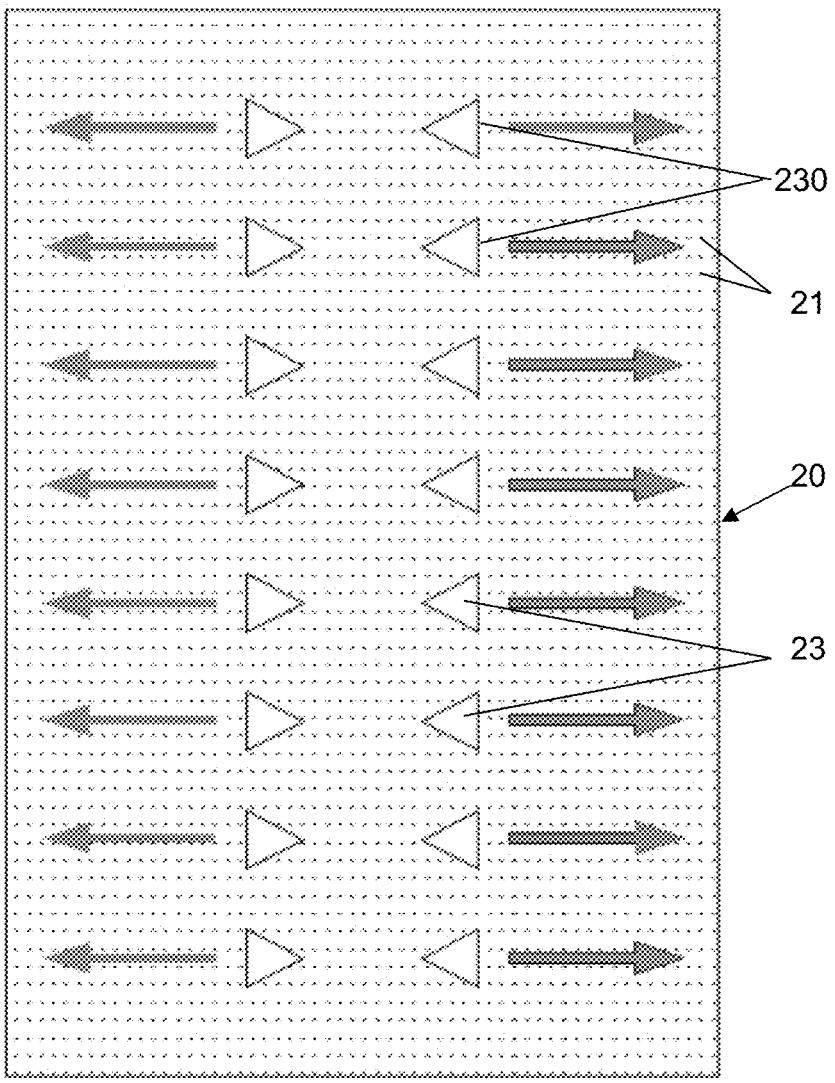
FIG. 9 shows another preferred embodiment of the outlet wall of a ceiling or wall based diffuser.

FIG. 9 shows another exemplary embodiment of the outlet wall 20 of the air-conditioning diffuser according to the present invention. The outlet wall 20 comprises an array of through-holes 22 and an array of auxiliary through-holes 21. The outlet wall 20 has a rectangular shape and the through-holes 22 are arranged in two rows, which are parallel to the longer lateral edges of the outlet wall 20 and provided with the air deflecting pockets 23, the outlet orifices 230 of the air deflecting pockets facing said longer lateral edges of the outlet wall 20 in order to direct the air streams flowing out of the individual through-holes 22, namely such that the individual air streams conically widen along the plane of the outlet wall 20.

The exemplary embodiment shown in FIGS. 5 to 9 enables the desired air flow to be achieved via the above described holes arranged in the outlet wall 20 of the ceiling or wall based diffuser. The mere perforation of the outlet wall 20 would mostly not ensure a sufficient air flow to be achieved. Although a simple increase in the number and/or size of the holes provided in the outlet wall 20 would enable an increase of a flow rate of the air passing through the outlet wall 20, such an increase would be connected with an additional risk of occurrence of draughts. In contrast to that, the air deflecting pockets 23 according to the present invention cause the air streams flowing out of the corresponding holes to dissipate or to swirl in the area adjoining the plane of the outlet wall 20.

Although the use of the auxiliary through holes 21 is not necessary in any of the above mentioned embodiments, it is considered to be favourable, thus constituting a feature of a preferred embodiment. In the case of an air-conditioning element without the auxiliary holes 21, the air deflecting pockets 23 are determinative with respect to the directions of the corresponding air streams. In the case of an air-conditioning element provided with the auxiliary holes 21, the air deflecting pockets 23 are typically not determinative. Nevertheless, they will considerably influence the resulting directions of the corresponding air streams.

Preferably, the air-conditioning element including the air deflecting pockets according to the present invention is made of a woven or non-woven fabric or foil. Thus, it is machine-washable and has a lower weight when compared to an air-conditioning element made of a metallic material.

Although multiple exemplary embodiments are described above, it is obvious that those skilled in the art would easily appreciate further possible alternatives to those embodiments. Hence, the scope of the present invention is not limited to the above exemplary embodiments, but it is rather defined by the appended claims.

The invention claimed is:

1. Air-conditioning diffuser for distributing air, the diffuser comprising:

a chamber provided with an inlet for feeding air and with an outlet wall made of a woven or non-woven fabric or foil, the outlet wall comprising at least one array of through-holes for distributing air into the surrounding environment; and a plurality of air deflectors for redirecting the air flowing through the through-holes out of the air-conditioning diffuser, each of the air deflectors being attached to and extending outwardly from the outlet wall on the outer side of the same, placed over at least one of the through-holes spaced apart from the at least one through-hole and being open towards the surrounding environment, while each of the plurality of air deflectors is attached to the outlet wall by means of a pair of its lateral edges, which mutually form an acute angle, and/or the air deflector defines a cavity which widens towards outlet orifice of the air deflector.

2. Air-conditioning diffuser according to claim 1, wherein the air-conditioning diffuser is constituted by an air-conditioning duct comprising an inlet for feeding air, an outlet wall for distributing air and an outlet for leading away a portion of the air.

3. Air-conditioning diffuser according to claim 1, wherein the air deflector assumes a shape corresponding to a part of the shell of a truncated cone.

4. Air-conditioning diffuser according to claim 1, further comprising an array of auxiliary holes formed in the outlet wall.

5. Air-conditioning diffuser according to claim 4, wherein at least some of the auxiliary holes have an area ranging between 0.1 to 1 $mm^2$.

6. Air-conditioning diffuser according to claim 5, wherein at least some of the through-holes have an area which is larger than that of the auxiliary holes.

7. Air-conditioning diffuser according claim 4, wherein the air deflector opens towards the surrounding environment which adjoins at least some of the auxiliary holes belonging said array of auxiliary holes in order to direct the air stream flowing via the through-hole into the air stream flowing out of at least some of the auxiliary holes.

8. Air-conditioning diffuser according to claim 4, wherein the air-conditioning diffuser is constituted by a ceiling or wall based diffuser, the air deflectors being adapted for directing the air flow in at least two mutually divergent directions.

9. Air-conditioning diffuser according to claim 8, wherein the array of auxiliary holes is arranged in a circular plane.

10. Air-conditioning diffuser according to claim 8, wherein the through-holes with the corresponding air deflectors are adapted for directing the air flow in a direction tangential with respect to at least one circle having its center in the central area of the outlet wall and/or to the circle that is concentric with the circular plane containing the auxiliary holes.

11. Air-conditioning diffuser according to claim 8, wherein each air deflector, which is assigned to the respective through-hole, is adapted for directing the air flow in a way causing the air stream flowing out of said air deflector to widen conically along the plane of the outlet wall.

* * * * *